US011339545B2

(12) United States Patent
Hsu

(10) Patent No.: US 11,339,545 B2
(45) Date of Patent: May 24, 2022

(54) SOUND ABSORBING BOARD

(71) Applicant: Hung-Ming Hsu, New Taipei (TW)

(72) Inventor: Hung-Ming Hsu, New Taipei (TW)

( * ) Notice: Subject to any disclaimer, the term of this patent is extended or adjusted under 35 U.S.C. 154(b) by 317 days.

(21) Appl. No.: 16/574,075

(22) Filed: Sep. 17, 2019

(65) Prior Publication Data

US 2020/0131724 A1 Apr. 30, 2020

(30) Foreign Application Priority Data

Oct. 31, 2018 (TW) ..... 107138602

(51) Int. Cl.

| | |
|---|---|
| ***E01F 8/00*** | (2006.01) |
| ***E04B 1/82*** | (2006.01) |
| ***E04B 1/84*** | (2006.01) |
| *E04B 1/74* | (2006.01) |

(52) U.S. Cl.

CPC ..... *E01F 8/0052* (2013.01); *E01F 8/0017* (2013.01); *E01F 8/0023* (2013.01)

(58) Field of Classification Search

CPC ..... E01F 8/0052; E01F 8/0047; E01F 8/0005; E01F 8/00; E01F 8/0017; E01F 8/0023; E01F 8/0041; E01F 8/0064; E04B 1/82; E04B 1/8227; E04B 1/84; E04B 1/8409; E04B 2001/8414; E04B 2001/8423; E04B 2001/8428; E04B 2001/8433; E04B 2001/8438; E04B 2001/8442; E04B 2001/8447; E04B 2001/849; E04B 2001/8495

See application file for complete search history.

(56) References Cited

U.S. PATENT DOCUMENTS

| | | | | |
|---|---|---|---|---|
| 1,791,232 A * | 2/1931 | Borkenstein | E04B 1/86 181/293 |
| 1,918,149 A * | 7/1933 | Sullivan | E04B 1/86 428/132 |
| 2,153,320 A * | 4/1939 | Venxie | E04B 9/0485 52/508 |
| 3,814,208 A * | 6/1974 | Morresi | F24F 13/068 181/293 |
| 3,861,493 A * | 1/1975 | Payne | E04B 1/86 181/293 |
| 3,968,837 A * | 7/1976 | Makara | E04C 2/292 165/135 |

(Continued)

*Primary Examiner* — Edgardo San Martin
(74) *Attorney, Agent, or Firm* — Hershkovitz & Associates, PLLC; Abe Hershkovitz

(57) ABSTRACT

The sound absorbing board includes a body and multiple sound absorbing elements. The body has a first side surface and a second side surface. The multiple sound absorbing elements are formed on the body at spaced intervals, and each one of the multiple sound absorbing elements has a protrusion, a groove, and two sound absorbing openings. The protrusion is formed on the first side surface of the body. The groove is formed on the second side surface of the body and has multiple concave portions and at least one convex portion. The multiple concave portions are formed on a bottom surface of the groove. The at least one convex portion is formed on the bottom surface of the groove, and is formed between two adjacent ones of the multiple concave portions. The two sound absorbing openings are formed on the two opposite side surfaces of the protrusion, respectively.

14 Claims, 8 Drawing Sheets

(56) References Cited

U.S. PATENT DOCUMENTS

| | | | | | |
|---|---|---|---|---|---|
| 4,373,608 | A * | 2/1983 | Holmes | G10K 11/172 | 181/202 |
| 4,555,433 | A * | 11/1985 | Jablonka | G10K 11/172 | 428/166 |
| 5,854,453 | A * | 12/1998 | Fujiwara | G10K 11/172 | 181/293 |
| 6,194,052 | B1 * | 2/2001 | Knipstein | E04B 1/86 | 428/132 |
| 7,677,359 | B2 * | 3/2010 | Vigran | G10K 11/16 | 181/293 |
| 8,579,080 | B2 * | 11/2013 | Angelico | E01F 8/0076 | 181/293 |
| 2006/0131104 | A1 * | 6/2006 | Yamaguchi | B60R 13/08 | 181/293 |
| 2006/0289229 | A1 * | 12/2006 | Yamaguchi | G10K 11/172 | 181/290 |

* cited by examiner

SOUND ABSORBING BOARD

BACKGROUND OF THE INVENTION

1. Field of the Invention

The present invention relates to a sound absorbing board, and more particularly to a sound absorbing board disposed at sides of a highway.

2. Description of Related Art

Conventional sound absorbing boards are broadly utilized at many places such as two sides of a highway so as to absorb noises produced by vehicles.

The conventional sound absorbing boards can be classified into two kinds according to their manufacturing methods and structures.

The first kind of the conventional sound absorbing board is manufactured by shearing multiple sound absorbing holes on a board via punching. However, acoustic impedance is increased when an inner diameter of each one of the multiple sound absorbing holes is decreased, so a sound absorbing hole with a smaller inner diameter has better sound absorbing effect. Formed by punching, the inner diameter of each one of the multiple sound absorbing holes is too large to absorb sound effectively. Thus, a sound absorbing foam is usually attached to the first kind of conventional sound absorbing board to enhance the sound-absorbing ability.

With reference to FIGS. 7 and 8, the second kind of the conventional sound absorbing board is manufactured by forming multiple grooves 91 on a bottom surface of a board 90 by punching. Protrusions 92 are simultaneously formed on a top surface of the board 90 when forming the multiple grooves 91 by punching. An opening 93 is formed between the top surface of the board 90 and a corresponding protrusion 92, and the opening 93 communicates with the corresponding groove 91 that is formed on the bottom surface of the board 90 simultaneously with the protrusion 92. Since an area of the opening 93 is smaller than an area of each one of the multiple sound absorbing holes of the first kind of the conventional sound absorbing board, the second kind of the conventional sound absorbing board has better sound absorbing effect than the first kind of the conventional sound absorbing board. Therefore, the second kind of the conventional sound absorbing board does not need attachment of the sound absorbing foam.

However, the abovementioned two kinds of the conventional sound absorbing boards both have their own drawbacks.

1. The sound absorbing foam utilized in the first kind of the conventional sound absorbing board increases the manufacturing cost and is hazardous to the environment. Therefore, manufacturing of the first kind of the conventional sound absorbing board is not friendly to the environment.

2. Although the second kind of the conventional sound absorbing board does not need the sound absorbing foam and has better sound-absorbing effect, the sound-absorbing effect is still not good enough. The opening 93 has better sound-absorbing effect when the opening 93 is long and narrow. To put it more specifically, when a height H2 of the opening 93 is shorter than a width W2 and the width W2 is longer than a specific value, the opening 93 attains better sound-absorbing effect. To attain better sound-absorbing effect, the width W2 of the opening 93 is elongated to make the opening 93 long and narrow as shown in FIG. 7. However, the board 90 is also elongated as the opening 93 is elongated, so the structural strength of the board 90 is decreased. Therefore, life expectancy of the second kind of the conventional sound absorbing board is short.

To overcome the shortcomings of the conventional sound absorbing board, the present invention tends to provide a sound absorbing board to mitigate or obviate the aforementioned problems.

SUMMARY OF THE INVENTION

The main objective of the present invention is to provide a sound absorbing board that maintains structural strength of a body of the sound absorbing board.

The sound absorbing board includes a body and multiple sound absorbing elements. The body has a first side surface and a second side surface opposite the first side surface. The multiple sound absorbing elements are formed on the body at spaced intervals, and each one of the multiple sound absorbing elements has a protrusion, a groove, and two sound absorbing openings. The protrusion is formed on the first side surface of the body and extends along a longitudinal direction of the sound absorbing element. The groove is formed on the second side surface of the body, is located at a position corresponding to where the protrusion is located, and has multiple concave portions and at least one convex portion. The multiple concave portions are formed on a bottom surface of the groove and extend toward two opposite side surfaces of the protrusion along the longitudinal direction. The at least one convex portion is formed on the bottom surface of the groove, extends toward the two opposite side surfaces of the protrusion along the longitudinal direction, and is formed between two adjacent ones of the multiple concave portions. The two sound absorbing openings are formed on the opposite side surfaces of the protrusion along the longitudinal direction respectively and both communicate with the groove.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
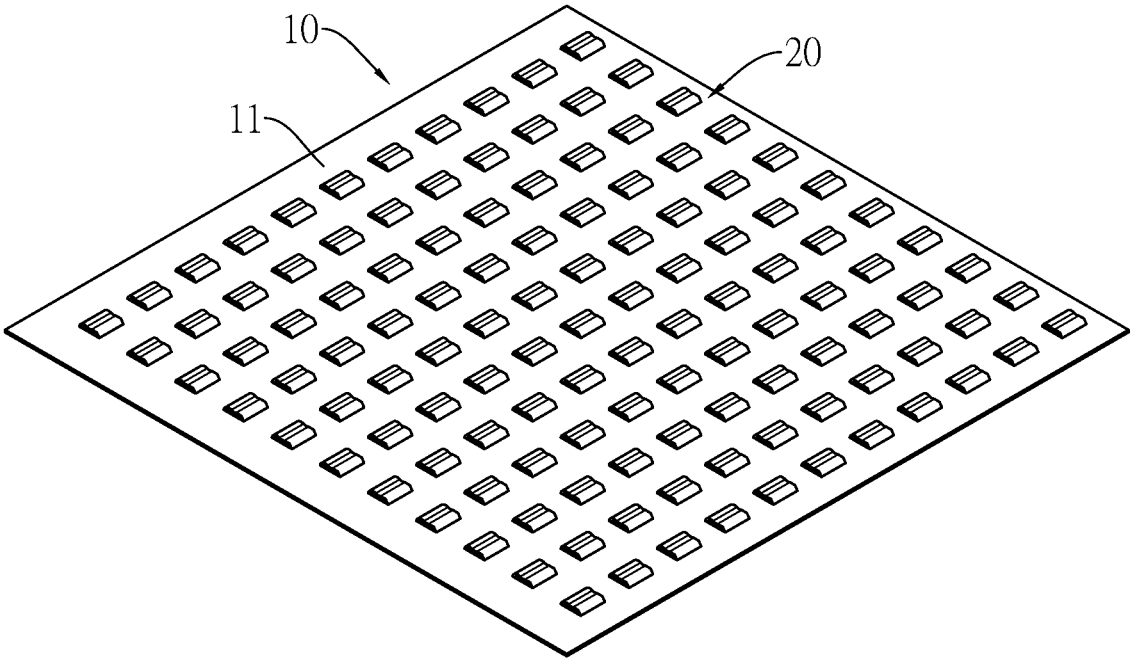
FIG. 1 is a perspective view of a first embodiment of a sound absorbing board in accordance with the present invention.
Figure 2:
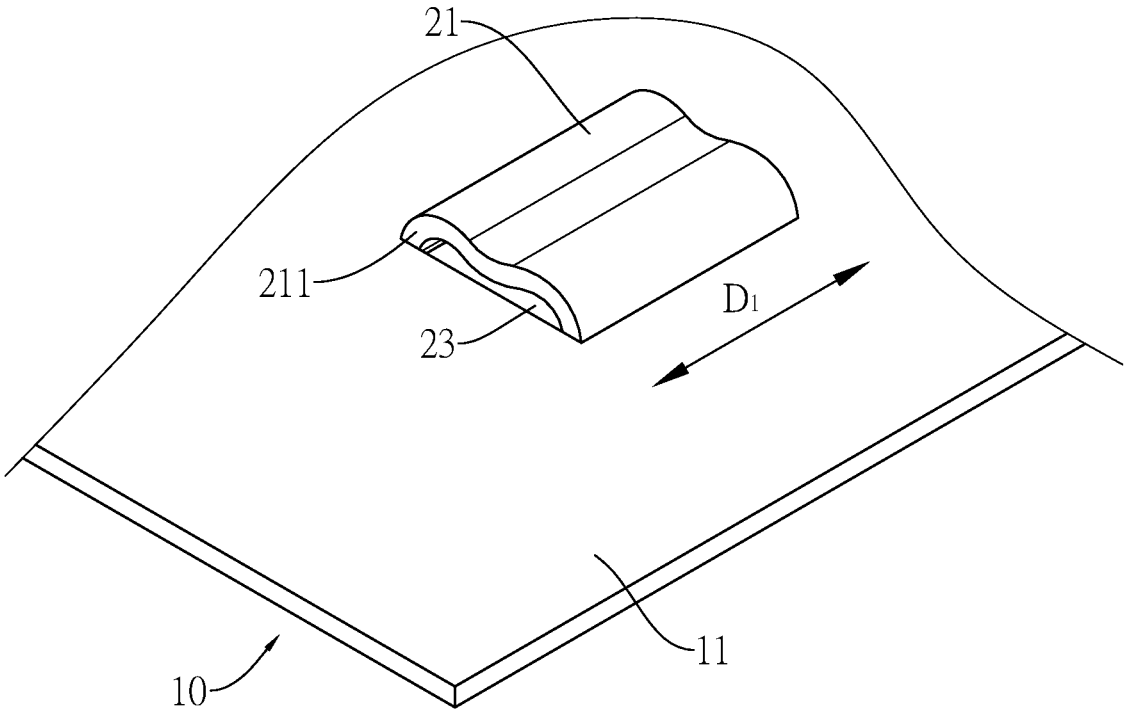
FIG. 2 is an enlarged perspective view of the sound absorbing board in FIG. 1.
Figure 3:
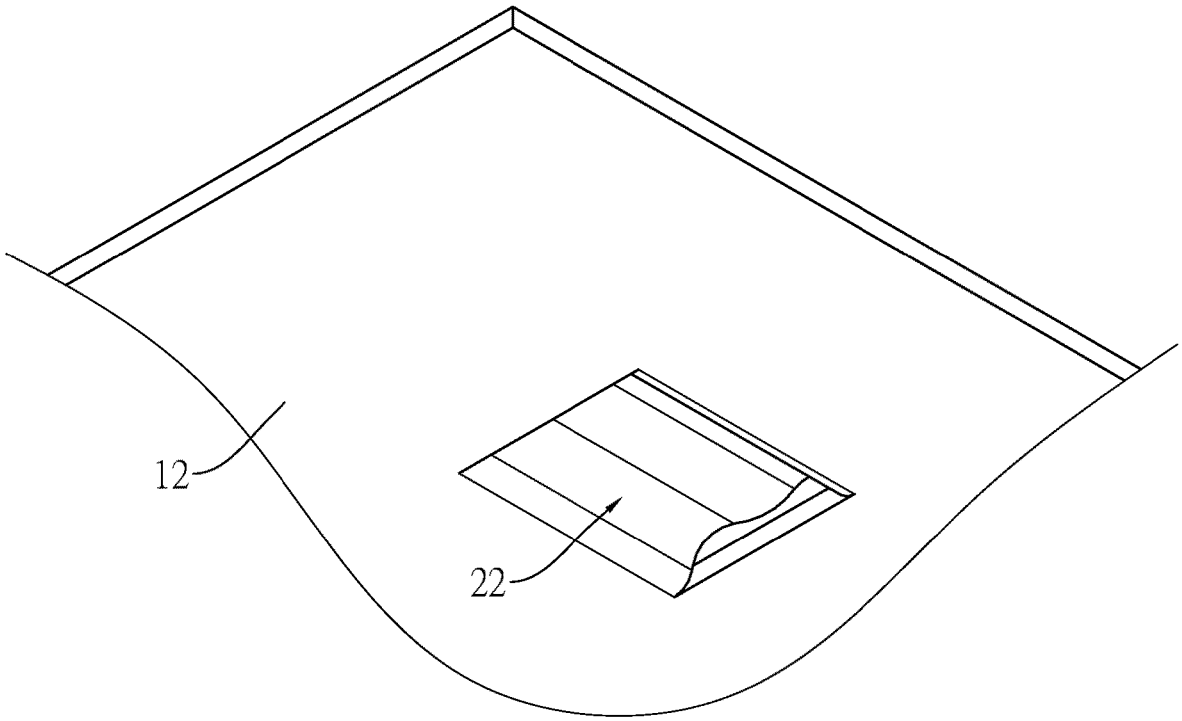
FIG. 3 is another enlarged perspective view of the sound absorbing board in FIG. 1.

With reference to FIGS. 1 to 3, a first embodiment of a sound absorbing board in accordance with the present invention includes a body 10 and multiple sound absorbing elements 20. The body 10 has a first side surface 11 and a second side surface 12 opposite the first side surface 11. In the present invention, the body 10 is a rectangular board, but a shape of the body 10 is not limited in the present invention.

With reference to FIG. 1, the multiple sound absorbing elements 20 are formed on the body 10 at spaced intervals. The multiple sound absorbing elements 20 are arranged as a grid, but the shape and configuration in which the multiple sound absorbing elements 20 are arranged are not limited in the present invention. In addition, a distance between each two adjacent ones of the multiple sound absorbing elements 20 is between 10 and 14 millimeters, end points included. Preferably, the distance between each two adjacent ones of the multiple sound absorbing elements 20 is 12 millimeters. However, the distance between each two adjacent ones of the multiple sound absorbing elements 20 is not limited in the present invention.

Figure 5:
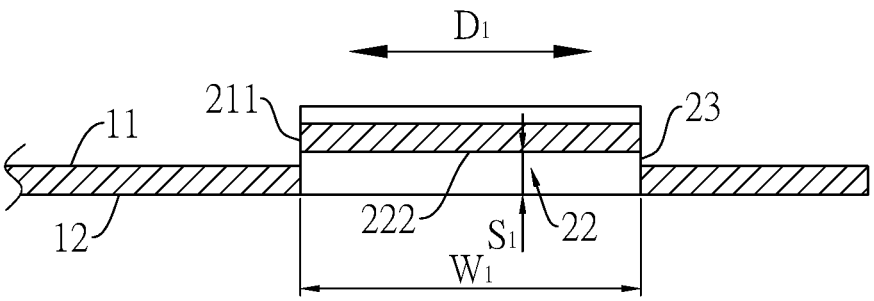
FIG. 5 is another enlarged cross-sectional side view of the sound absorbing board in FIG. 1.

With reference to FIGS. 2 and 5, each one of the multiple sound absorbing elements 20 has a protrusion 21, a groove 22, and two sound absorbing openings 23. The protrusion 21 is formed on the first side surface 11 of the body 10. In the present invention, the protrusion 21 extends along a longitudinal direction D1 of the sound absorbing element 20 and has two entrance surfaces 211. The two entrance surfaces 211 are formed on two opposite side surfaces of the protrusion 21 along the longitudinal direction D1, respectively.

Figure 4:
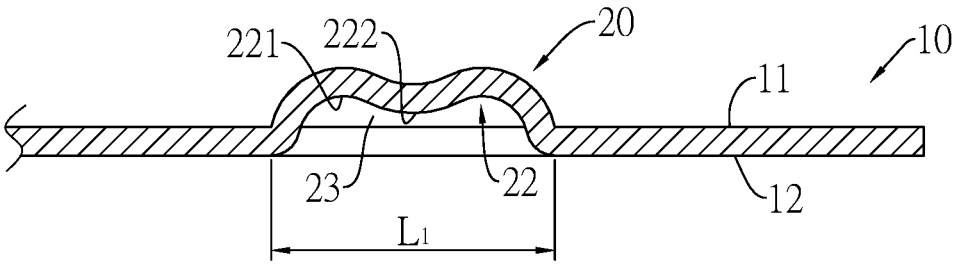
FIG. 4 is an enlarged cross-sectional side view of the sound absorbing board in FIG. 1.

With reference to FIGS. 3 and 4, the groove 22 is formed on the second side surface 12 of the body 10, and the groove 22 corresponds in position to the protrusion 21. The groove 22 further has multiple concave portions 221 and at least one convex portion 222 formed within. In the present invention, the groove 22 has two concave portions 221 and one convex portion 222 formed within. The two concave portions 221 are formed on two opposite sides of the convex portion 222, respectively. A number of the multiple concave portions 221 and a number of the at least one convex portion 222 are not limited in the present invention.

With reference to FIGS. 3 to 5, in the present invention, each one of the multiple concave portions 221 and the at least one convex portion 222 are formed on a bottom surface of the groove 22 and extend along the longitudinal direction D1. A surface of each one of the multiple concave portions 221 and a surface of the at least one convex portion 222 form a continuously curved surface together. Therefore, the surface of each one of the multiple concave portions 221 and the surface of the at least one convex portion 222 make the bottom surface of the groove 22 a wavy curved surface together. However, a shape of the surface formed by surfaces of the multiple concave portions 221 and of the at least one convex portion 222 is not limited to the continuously curved surface.

In the present invention, a distance between a tip of each one of the multiple concave portions 221 and a tip of the at least one convex portion 222 is between 0.05 and 0.15 millimeters, end points included. Preferably, the distance between the tip of each one of the multiple concave portions 221 and the tip of the at least one convex portion 222 is 0.1 millimeters.

Moreover, in the present invention, the protrusion 21 and the groove 22 are integrally formed on the body 10. The groove 22 is recessed on the second side surface 12 of the body 10 toward the first side surface 11 upwardly, such that the protrusion 21 protrudes upwardly on the first side surface 11 of the body 10. That is, a shape of the bottom surface of the groove 22 corresponds to a shape of a top surface of the protrusion 21. The bottom surface of the groove 22 and the top surface of the protrusion 21 are both wavy curved surfaces. However, the shape of the bottom surface of the groove 22 and the shape of the top surface of the protrusion 21 are not limited in the present invention.

With reference to FIG. 5, in the present invention, a distance S1 between the bottom surface of the groove 22 and the second side surface 12 of the body 10 is longer than a distance between the second side surface 12 of the body 10 and the first side surface 11 of the body 10.

With reference to FIGS. 3 to 5, since the groove 22 is recessed on the second side surface 12 of the body 10 toward the first side surface 11 upwardly, an opening is formed through the body 10 and is located below the bottom surface of the groove 22. A contour of the opening is rectangular and the opening has a length L1 and a width W1 shorter than the length L1. The length L1 is between 5 and 7 millimeters, end points included. Preferably, the length L1 is 6 millimeters. The width W1 is between 4 and 6 millimeters, end points included. Preferably, the width W1 is 5 millimeters. The distance S1 between the bottom surface of the groove 22 and the second side surface 12 of the body 10 is between 1 and 1.3 millimeters, end points included. Preferably, the distance S1 is 1.15 millimeters. Numerical values of the length L1, the width W1, and the distance S1 are not limited in the present invention.

With reference to FIGS. 2, 4, and 5, the two sound absorbing openings 23 are formed on the two opposite side surfaces of the protrusion 21 respectively and both communicate with the groove 22. In the present invention, the two sound absorbing openings 23 are formed on the two entrance surfaces 211 respectively. Since the two entrance surfaces 211 are perpendicular to the first side surface 11 of the body 10, it is more convenient to form the two sound absorbing openings 23 on the two entrance surfaces 211 in a machining process.

In addition, because the distance S1 between the bottom surface of the groove 22 and the second side surface 12 of the body 10 is longer than the distance between the second side surface 12 of the body 10 and the first side surface 11 of the body 10, each one of the two sound absorbing openings 23 is consequentially formed between the bottom surface of the groove 22 and the first side surface 11 of the body 10. In such a configuration, a processor can easily make each one of the two sound absorbing openings 23 communicate with the groove 22 from the protrusion 21 in the machining process.

In the present invention, a width of each one of the two sound absorbing openings 23 is between 0.05 and 0.15 millimeters, end points included. Preferably, the width of each one of the two sound absorbing openings 23 is 0.1 millimeters. Contour of each one of the two sound absorbing openings 23 may be wavy as the bottom surface of the groove 22 is the wavy curved surface. However, the contour of each one of the two sound absorbing openings 23 is not limited in the present invention.

Figure 6:
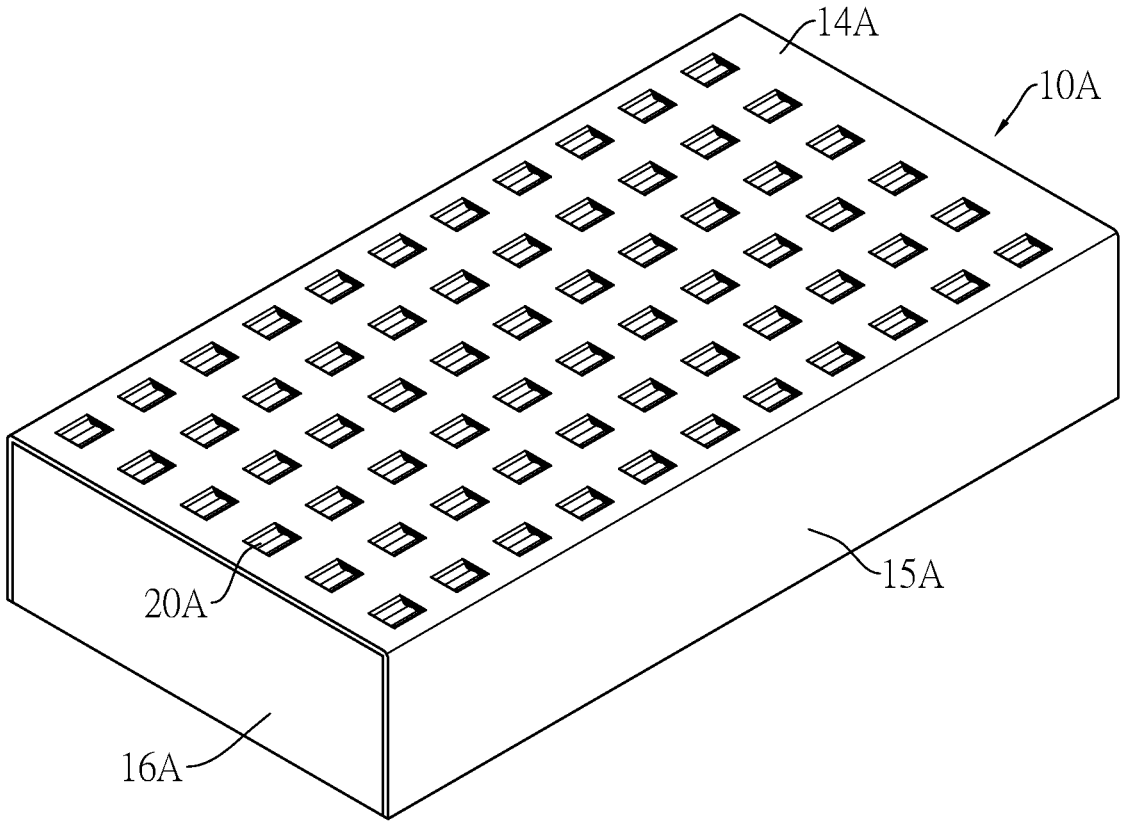
FIG. 6 is a perspective view of a second embodiment of a sound absorbing board in accordance with the present invention.
Figure 7:
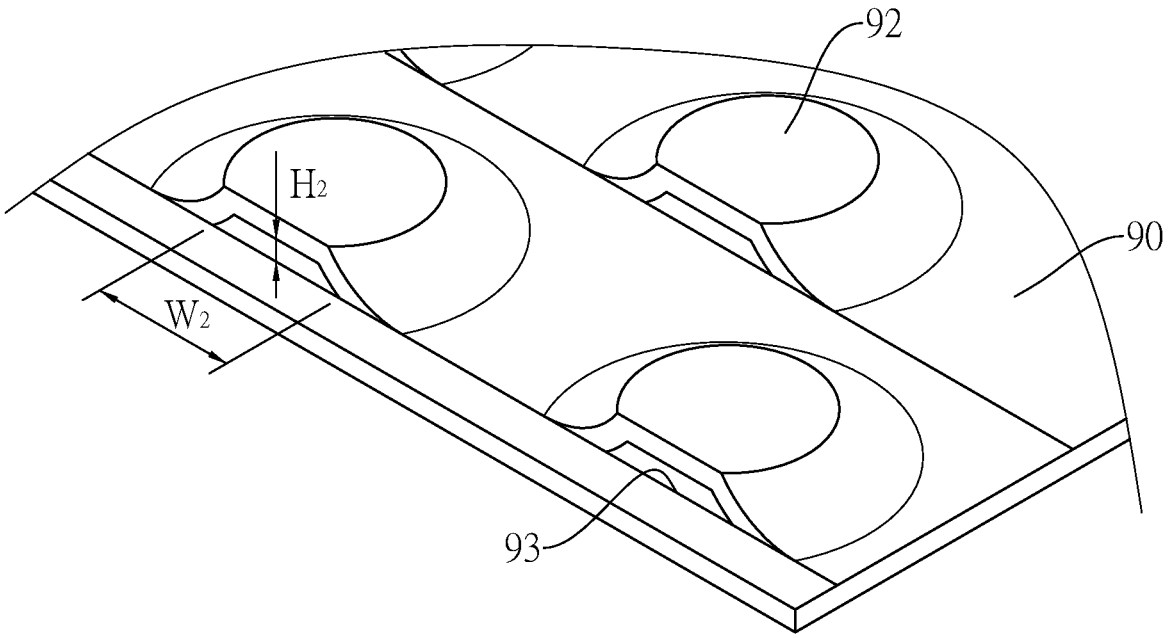
FIG.7 PRIOR ART
FIG. 7 is an enlarged perspective view of a sound absorbing board in accordance with the prior art.
Figure 8:
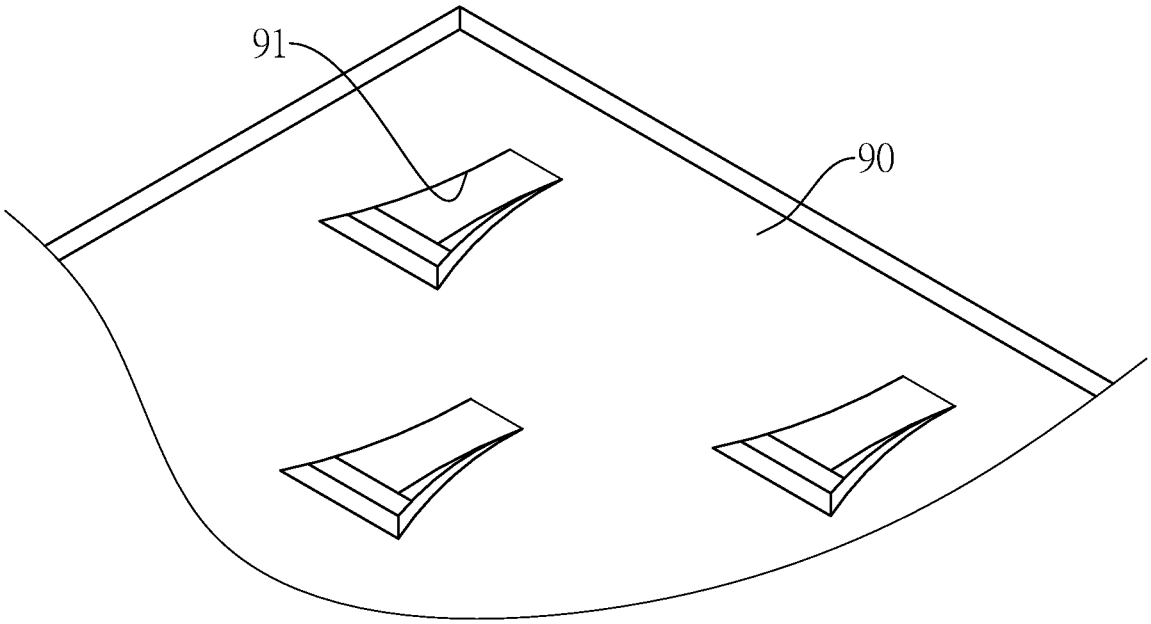
FIG.8 PRIOR ART
FIG. 8 is another enlarged perspective view of the sound absorbing board in FIG. 7.

With reference to FIG. 6, a second embodiment of a sound absorbing board in accordance with the present invention is substantially the same as the first embodiment, and the difference between the second embodiment and the first embodiment is that: the body 10A is a hollow block-like case. The body 10A may be fixed on a wall. Since it is easy to form the multiple sound absorbing elements 20A on the body 10A, the processor can adjust positions to form the multiple sound absorbing elements 20. That is, the body 10A further includes a central board 14A, two side boards 15A, and a bottom board 16A. The two side boards 15A are perpendicularly mounted to two opposite sides of the central board 14A, respectively. The bottom board 16A is mounted to the central board 14A and the two side boards 15A. If the two side boards 15A of the sound absorbing board shown in FIG. 3 do not face noise sources, the multiple sound absorbing elements 20A may be formed merely on the central board 14A. In this way, unnecessary manufacture processes can be omitted. The two side boards 15A and the bottom board 16A provide the central board 14A with a supporting effect.

With reference to FIGS. 2, 4, and 5, in use, the sound absorbing board is disposed erectly, and either the first side surface 11 or the second side surface 12 is faced with the noise sources. Take the sound absorbing board installed by the highway for example; either the first side surface 11 or the second side surface 12 is faced with the noise sources. When noise from the highway is transmitted into each one of the two sound absorbing openings 23 of each one of the multiple sound absorbing elements 20 from the first side surface 11, air in each one of the two sound absorbing openings 23 starts to oscillate. Then acoustic energy of the noise decreases due to viscous drag of the air and friction between the oscillating air molecules and the bottom surface of the groove 22, and hence each one of the two sound absorbing openings 23 of each one of the multiple sound absorbing elements 20 is capable of absorbing the noise.

With reference to FIGS. 3, 4, and 5, when noise from the highway is transmitted into the groove 22 of each one of the multiple sound absorbing elements 20 from the second side surface 12, the noise is reflected into the two sound absorbing openings 23 of the corresponding sound absorbing element 20 upon reaching the bottom surface of the groove 22. Hence acoustic energy of the noise also decreases since part of the acoustic energy is absorbed by each one of the two sound absorbing openings 23 of the corresponding sound absorbing element 20. Thus, regardless that the sound absorbing board faces the noise sources with the first side surface 11 or the second side surface 12, the noise from the highway can be absorbed by each one of the two sound absorbing openings 23 of each one of the multiple sound absorbing elements 20.

With reference to FIGS. 4 and 5, furthermore, the multiple concave portions 221 and the at least one convex portion 222 make the contour of each one of the two sound absorbing openings 23 of each one of the multiple sound absorbing elements 20 wavy, which divides a space between the two sound absorbing openings 23 of the corresponding sound absorbing elements 20 into multiple air chambers. Each one of the multiple air chambers has a different height, such that each one of the two sound absorbing openings 23 of each one of the multiple sound absorbing elements 20 can absorb sounds with different frequencies. In addition, since the wavy contour of each one of the two sound absorbing openings 23 of each one of the multiple sound absorbing elements 20 can destroy waveform of the sound, the two sound absorbing openings 23 of each one of the multiple sound absorbing elements 20 also reduce noise by preventing the sound from reflecting completely.

The sound absorbing board in accordance with the present invention has the following advantages:

1. Each one of the multiple sound absorbing elements 20 has two sound absorbing openings 23, and the width of each one of the two sound absorbing openings 23 is ten times the width W2 of the opening 93 of the second kind of the conventional sound absorbing board. Therefore, each one of the multiple sound absorbing elements 20 has better sound-absorbing effect than that of the opening 93 of the second kind of the conventional sound absorbing board.

2. Since each one of the multiple sound absorbing elements 20 has two sound absorbing openings 23 and the width of each one of the two sound absorbing openings 23 is ten times the width W2 of the opening 93 of the second kind of the conventional sound absorbing board, there is no need to elongate each one of the two sound absorbing openings 23 of the multiple sound absorbing elements 20 in manufacturing. Therefore, structural strength of the body 10 is not decreased as the board 90 of the second kind of the conventional sound absorbing board is.

3. As each one of the multiple sound absorbing elements 20 has better sound-absorbing effect than the opening 93 of the second kind of the conventional sound absorbing board, a number of the multiple sound absorbing elements 20 necessarily to be manufactured on the body 10 is less than a number of the multiple grooves 91 necessarily to be punched on the board 90.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A sound absorbing board comprising:

a body having a first side surface;

a second side surface opposite the first side surface;

multiple sound absorbing elements formed on the body at spaced intervals, each of the multiple sound absorbing elements having:

a protrusion formed on the first side surface of the body and extending along a longitudinal direction of the sound absorbing elements;

a groove formed on the second side surface of the body, located at a position corresponding to where the protrusion is located, and having multiple concave portions formed on a bottom surface of the groove and extending toward two opposite side surfaces of the protrusion along the longitudinal direction;

at least one convex portion formed on the bottom surface of the groove, extending toward the two opposite side surfaces of the protrusion along the longitudinal direction, and formed between two adjacent ones of the multiple concave portions;

two sound absorbing openings formed on the two opposite side surfaces of the protrusion along the longitudinal direction respectively, the two sound absorbing openings communicating with the groove;

wherein the multiple concave portions and the at least one convex portion divide a space between the two sound absorbing openings into multiple upper air chambers and at least one lower air chamber, the multiple concave portions correspond to the multiple upper air chambers in position, and the at least one convex portion corresponds to the at least one lower air chamber in position;

wherein a distance between the bottom surface of the groove of each one of the multiple sound absorbing elements and the second side surface of the body is longer than a distance between the second side surface of the body and the first side surface of the body;

wherein an opening formed through the body, is located below the bottom surface of the groove, and has a rectangular contour;

a length; and a width shorter than the length.

2. The sound absorbing board as claimed in claim 1, wherein a surface of each one of the multiple concave portions of the groove of a respective one of the multiple sound absorbing elements and a surface of the at least one convex portion of the corresponding groove form a continuously curved surface together.

3. The sound absorbing board as claimed in claim 1, wherein a tip of each one of the multiple concave portions of the groove of a respective one of the multiple sound absorbing elements and a tip of the at least one convex portion of the corresponding groove is between 0.05 and 0.15 millimeters, end points included.

4. The sound absorbing board as claimed in claim 1, wherein in each sound absorbing element, the bottom surface of the groove corresponds in shape to a top surface of the protrusion.

5. The sound absorbing board as claimed in claim 2, wherein in each sound absorbing element, the bottom surface of the groove corresponds in shape to a top surface of the protrusion.

6. The sound absorbing board as claimed in claim 3, wherein in each sound absorbing element, the bottom surface of the groove corresponds in shape to a top surface of the protrusion.

7. The sound absorbing board as claimed in claim 1, wherein a width of each one of the two sound absorbing openings is between 0.05 and 0.15 millimeters, end points included.

8. The sound absorbing board as claimed in claim 2, wherein a width of each one of the two sound absorbing openings is between 0.05 and 0.15 millimeters, end points included.

9. The sound absorbing board as claimed in claim 3, wherein a width of each one of the two sound absorbing openings is between 0.05 and 0.15 millimeters, end points included.

10. The sound absorbing board as claimed in claim 1, wherein the length of the opening of the body is between 5 and 7 millimeters, end points included.

11. The sound absorbing board as claimed in claim 2, wherein the length of the opening of the body is between 5 and 7 millimeters, end points included.

12. The sound absorbing board as claimed in claim 3, wherein the length of the opening of the body is between 5 and 7 millimeters, end points included.

13. The sound absorbing board as claimed in claim 1, wherein the distance between the bottom surface of the groove and the second side surface of the body is between 1 and 1.3 millimeters, end points included.

14. The sound absorbing board as claimed in claim 1, wherein the opening formed through the body is between 4 and 6 millimeters, end points included.

* * * * *